US010265559B1

(12) United States Patent
Downs

(10) Patent No.: US 10,265,559 B1
(45) Date of Patent: Apr. 23, 2019

(54) FIRE-HOSE NOZZLE

(71) Applicant: Lonnie R Downs, Princeton, TX (US)

(72) Inventor: Lonnie R Downs, Princeton, TX (US)

( * ) Notice: Subject to any disclaimer, the term of this patent is extended or adjusted under 35 U.S.C. 154(b) by 0 days.

(21) Appl. No.: 14/657,407

(22) Filed: Mar. 13, 2015

Related U.S. Application Data

(60) Provisional application No. 61/954,964, filed on Mar. 18, 2014.

(51) Int. Cl.

| | |
|---|---|
| ***A62C 31/02*** | (2006.01) |
| ***A62C 17/00*** | (2006.01) |
| ***A62C 31/00*** | (2006.01) |
| ***A62C 31/03*** | (2006.01) |
| ***B05B 1/34*** | (2006.01) |
| ***B05B 1/30*** | (2006.01) |

(52) U.S. Cl.
CPC ..... *A62C 31/02* (2013.01); *A62C 17/00* (2013.01); *A62C 31/005* (2013.01); *A62C 31/03* (2013.01); *B05B 1/30* (2013.01); *B05B 1/34* (2013.01)

(58) Field of Classification Search
CPC ..... A62C 17/00; A62C 31/02; A62C 31/03; A62C 31/12; B05B 7/0425; E03C 1/084
See application file for complete search history.

(56) References Cited

U.S. PATENT DOCUMENTS

| | | | | |
|---|---|---|---|---|
| 1,496,338 | A * | 6/1924 | Haley | 251/357 |
| 1,721,449 | A | 7/1929 | Helmeke | |
| 2,513,417 | A * | 7/1950 | Lindsay | 261/116 |
| 2,585,509 | A | 2/1952 | Smith | |
| 2,919,071 | A | 12/1959 | Dalton | |
| 3,539,112 | A | 11/1970 | Thompson | |
| 3,497,141 | A | 12/1970 | Rydberg | |
| 4,420,047 | A * | 12/1983 | Bruensicke | 169/53 |
| 5,054,688 | A * | 10/1991 | Grindley | 239/407 |
| 5,275,763 | A * | 1/1994 | Fukai | 261/78.2 |
| 5,590,719 | A * | 1/1997 | McLoughlin et al. | 169/70 |
| 7,207,501 | B2 * | 4/2007 | Hanratty | 239/432 |
| 2001/0020650 | A1 * | 9/2001 | Lanteri | A62C 31/03 239/533.1 |
| 2009/0178812 | A1 * | 7/2009 | Solomon et al. | 169/14 |

FOREIGN PATENT DOCUMENTS

| | | |
|---|---|---|
| WO | WO9951307 | 10/1999 |

* cited by examiner

*Primary Examiner* — Ryan A Reis
(74) *Attorney, Agent, or Firm* — Kenneth L Tolar

(57) ABSTRACT

A fire-hose nozzle includes a cylindrical housing having an inlet, an outlet and a water passageway therebetween. Centrally disposed within the passageway is an elongated, rocket-shaped stem having a larger-diameter end near the inlet and a pointed, tapered end near the outlet. Proximal the inlet are circumferentially disposed apertures for injecting ambient air into incoming water to widen the spray pattern through the outlet. Attached to the inlet is a pistol-grip controller for coupling with a conventional fire hose. Therefore, when water is delivered to the housing, the stem disrupts and separates the water stream to decrease hose back pressure, recoil and oscillation.

16 Claims, 3 Drawing Sheets

FIRE-HOSE NOZZLE

CROSS REFERENCE TO RELATED APPLICATIONS

This application is entitled to the benefit of provisional patent application No. 61/954,964 filed on Mar. 18, 2014, the specification of which is incorporated herein by reference.

BACKGROUND OF THE INVENTION

The present invention relates to a fire-hose nozzle having a uniquely configured, internal stem that reduces hose recoil and back pressure during operation.

DESCRIPTION OF THE PRIOR ART

Conventional fire hoses typically have a nozzle at a distal end for projecting pressurized water towards a fire. Because the nozzle further increases the water pressure, the hose recoils and oscillates to the point that a single firefighter cannot typically control it without assistance. If the hose is inadvertently released, it endangers those nearby until the nozzle is recaptured or the water pressure is reduced. Furthermore, water projected from a conventional fire-hose nozzle often spreads an oil-fueled fire.

Accordingly, there is currently a need for a fire-hose nozzle that is easier to control than a conventional nozzle, and which more effectively extinguishes fires fueled by hydrocarbons. A review of the prior art reveals a myriad of fire nozzles. For example, international patent publication no. WO 9951307 to Steingass discloses a self-educing foam nozzle having an internal stem that causes water to efficiently educe a chemical flame retardant into the interior where it mixes with water to produce foam.

U.S. Pat. No. 1,721,449 issued to Helmeek discloses a device for handling and directing a fire-hose nozzle.

U.S. Pat. No. 2,585,509 issued to Smith discloses a fire-hose nozzle having an orifice that automatically adjusts in size according to water pressure.

U.S. Pat. No. 2,919,071 issued to Dalton discloses a fire-hose nozzle attachment including an elongated member attached to a fire hose having a pair of handgrips.

U.S. Pat. No. 3,497,141 to Rydberg discloses a frusto-conical attachment tethered to a fire-hose nozzle for directing high-pressure water through windows and other building openings.

U.S. Pat. No. 3,539,112 to Thompson discloses a fire-hose nozzle having an automated flow adjustment.

Although several fire-hose nozzles and nozzle attachments exist in the prior art, none are designed to reduce back pressure and hose recoil. The present invention overcomes the deficiencies of the prior art by providing a fire-hose nozzle having a uniquely-designed, internal stem that disrupts and separates an incoming water stream to reduce back pressure. The reduced back pressure allows the hose to be placed upon the ground with no risk of oscillation or uncontrollable movement. Furthermore, a single firefighter of any size can easily operate the nozzle with little risk of releasing or losing control of the hose. Finally, the uniquely designed nozzle reduces water consumption by 40-60%.

SUMMARY OF THE INVENTION

The present invention relates to a fire-hose nozzle including an elongated, cylindrical housing having an inlet, an outlet and a water passageway therebetween. Centrally suspended within the passageway is an elongated, rocket-shaped stem having a larger-diameter tubular portion near the inlet and a pointed, tapering portion near the outlet. Proximal the inlet are circumferentially disposed apertures for injecting ambient air into incoming water to widen the spray pattern through the outlet. Attached to the inlet is a pistol-grip controller for coupling with a conventional fire hose. Therefore, when water is delivered to the housing, the tubular portion of the stem impedes and disrupts the water stream to decrease hose back pressure, recoil and oscillation.

It is therefore an object of the present invention to provide a fire-hose nozzle that is easier to handle and control than a conventional nozzle.

It is another object of the present invention to provide a fire-hose nozzle having a uniquely shaped internal stem that disrupts water flow to reduce hose back pressure, recoil and oscillation.

It is yet another object of the present invention to provide a fire-hose nozzle having a sliding attachment that allows a user to vary the spray pattern of projected water while further reducing back pressure and enhancing the effectiveness of injected foaming agents.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
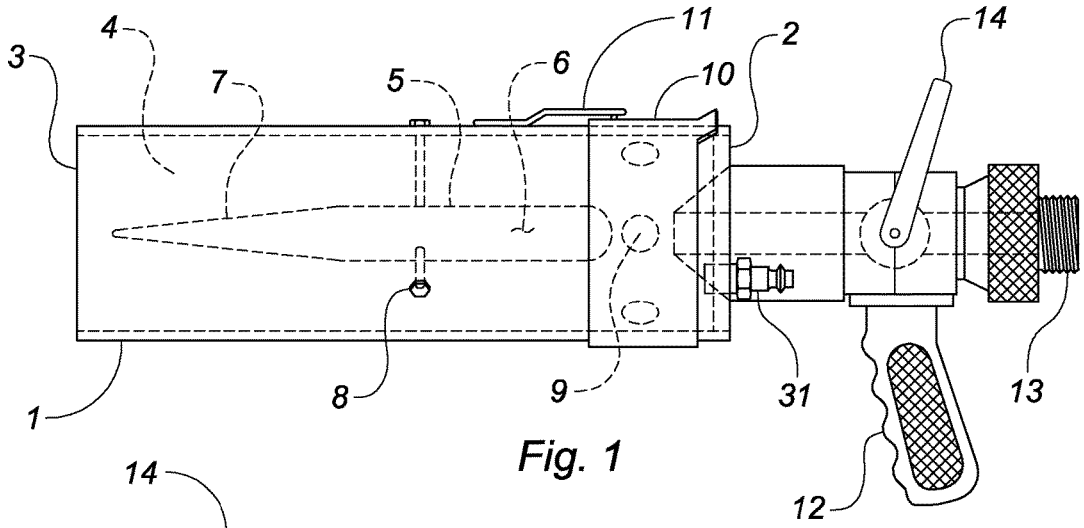
FIG. 1 is a side, plan view of the fire-hose nozzle according to the present invention.
Figure 2:
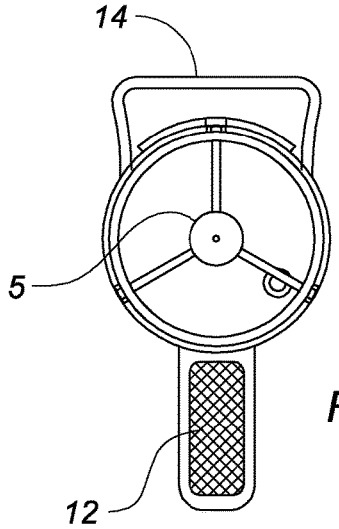
FIG. 2 is a front view of the nozzle.
Figure 3:
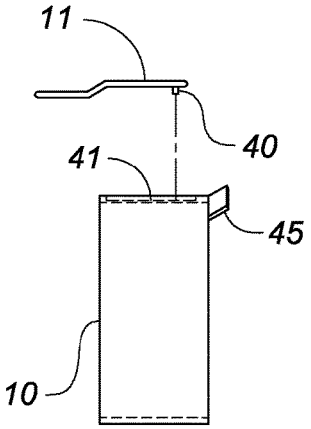
FIG. 3 is an isolated, exploded view of the collar.
Figure 4:
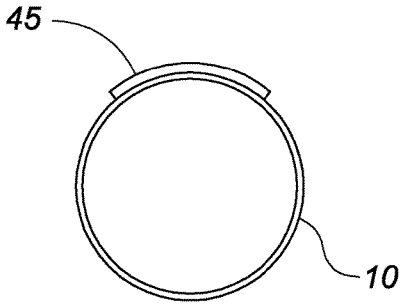
FIG. 4 is an isolated, front view of the collar.
Figure 5:
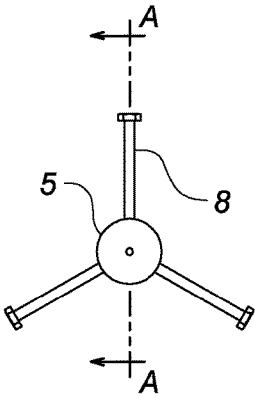
FIG. 5 is an isolated, facing view of the stem and attachment bolts.
Figure 6:
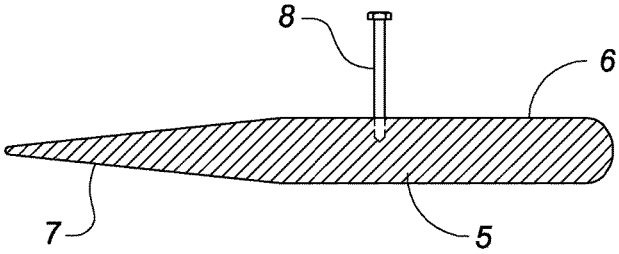
FIG. 6 is a cross-sectional view of the stem and attachment bolts taken along A-A of FIG. 5.
Figure 7:
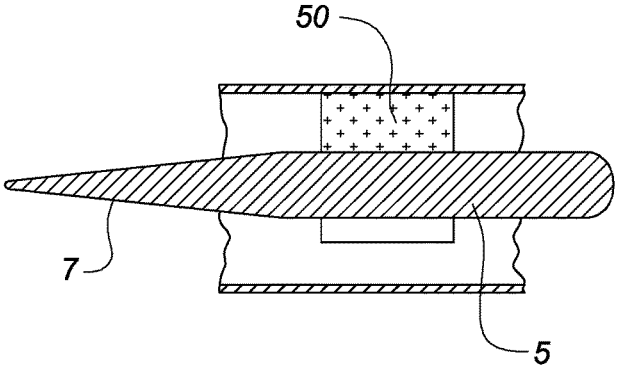
FIG. 7 is a sectional view of the housing, stem and attachment flanges that are used on smaller-diameter nozzles.

The present invention relates to a fire-hose nozzle including a cylindrical housing 1 having an inlet 2, an outlet 3 and a water passageway 4 therebetween. Centrally disposed within the passageway is an elongated, rocket-shaped stem 5 having a larger-diameter tubular portion 6 near the inlet and a tapered, pointed portion 7 near the outlet. Bolts 8 radially extend from the stem to the housing inner surface to axially suspend the stem within the water passageway. If the nozzle is designed to fit smaller-diameter hoses, the bolts are replaced with flanges 50 as depicted in FIG. 7.

Proximal the inlet are circumferentially disposed apertures 9 for injecting ambient air into incoming water to widen the spray pattern through the outlet. The apertures are selectively covered or exposed by a collar 10 slidably mounted on the housing exterior. A biased latch 11 includes a pin 40 that rides within a slot 41 on the collar to prevent inadvertent removal. A raised, semi-circumferential lip 45 provides an engagement surface for a firefighter's hand when sliding the collar forward or backward, even when encapsulated with a bulky work glove.

In addition to creating a wider spray pattern, the apertures also atomize the water to more effectively extinguish more tenacious fires, such as those fueled by oil or other hydrocarbons. The atomized water droplets increase both the total surface area and the heat-absorption capacity of water engaging the fire. The increased heat absorption also generates additional steam that further suffocates the fire.

Attached to the inlet is a pistol-grip controller 12 having a threaded port 13 for coupling with a conventional fire hose. A pivotal, U-shaped handle 14 opens an internal ball valve to allow water flow from the hose to the housing interior. Therefore, when water is delivered to the housing, the stem impedes and disrupts the water stream to decrease back pressure, recoil and oscillation.

The inlet may also include a quick-connect fitting 31 for coupling with a fluoro-surfactant foaming agent tube for trucks equipped with such devices to more quickly deprive oxygen from an ongoing fire. The fitting 31 includes a check valve to prevent back-flow of the foaming agent when the nozzle is not in use.

Figure 8:
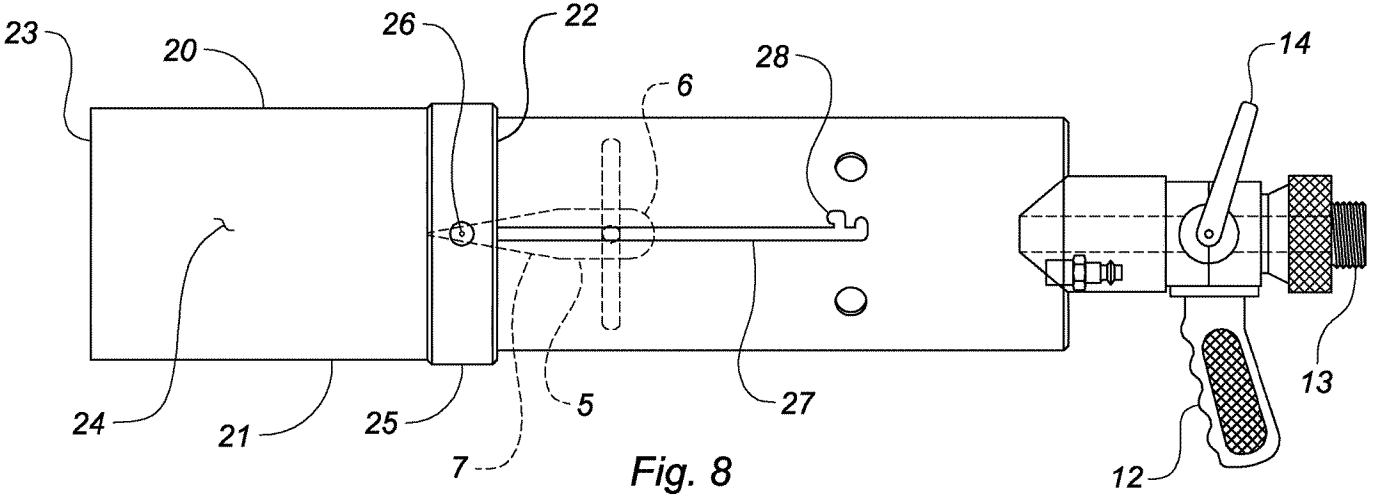
FIG. 8 depicts a second embodiment of the present invention with the attachment in an extended position.
Figure 9:
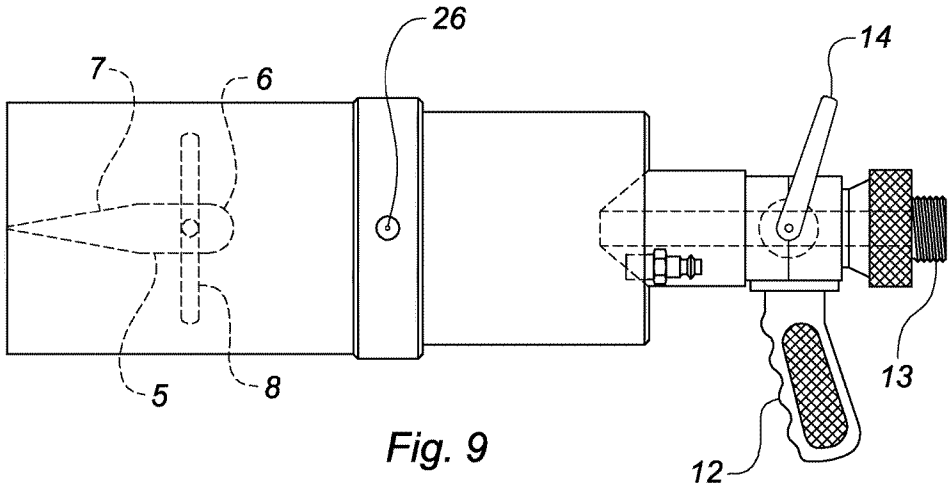
FIG. 9 depicts the embodiment of FIG. 8 with the attachment of FIG. 8 in a retracted position.

Now referring specifically to FIGS. 8 and 9, a slightly different embodiment includes an attachment 20 that allows a user to further modify the spray pattern of effluent water, as desired. The attachment includes a hollow sleeve 21 having an open first end 22 telescopically receiving the housing outlet 3, an opposing, open second end 23 and a water conduit 24 therebetween. The first end 22 includes a circumferential band 25 with a guide pin 26 depending from an interior surface. The guide pin rides within a longitudinal slot 27 formed on the housing that terminates at a transverse notch 28.

Accordingly, a user may slide the sleeve to an extended position as depicted in FIG. 8, wherein the conduit creates a more streamlined, concentrated flow pattern. Or, the user can retract and rotate the sleeve slightly to lock the pin within the notch, as depicted in FIG. 9, to create a wider spray pattern. In addition to varying the water-flow pattern, the sleeve in either position enhances the effectiveness of any foaming agents that are added via the fitting 31. Finally, the attachment further reduces hose back pressure relative to what the nozzle would otherwise achieve with the stem alone.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fire-hose nozzle comprising:

a housing having an inlet, an outlet and an interior water passageway therebetween;

an elongated, rocket-shaped stem within said water passageway and fixedly attached to said housing with bolts radially extending from said stem to said housing that axially suspend said stem within said water passageway, said stem having a large-diameter tubular portion near the inlet and a tapered, pointed portion near the outlet;

a controller coupled with said inlet and a fire hose distal end for controlling water flow from said hose to said water passageway, whereby when water is delivered to said passageway, the stem disrupts and separates incoming water to decrease back pressure, recoil and oscillation of said fire hose.

2. A fire-hose nozzle comprising:

a housing having an inlet, an outlet and an interior water passageway therebetween;

an elongated, rocket-shaped stem within said water passageway and fixedly attached to said housing with bolts radially extending from said stem to said housing that axially suspend said stem within said water passageway;

a controller coupled with said inlet and a fire-hose distal end for controlling water flow from a fire hose to said water passageway, whereby when water is delivered to said passageway, the stem disrupts and separates incoming water to decrease back pressure, recoil and oscillation of said fire hose.

3. The fire-hose nozzle according to claim 2 further comprising a plurality of apertures circumferentially disposed around the inlet of said housing for injecting ambient air into incoming water to widen a spray pattern through said outlet, and to atomize incoming water to more effectively extinguish a fire.

4. The fire-hose nozzle according to claim 3 further comprising a collar slidably mounted on said housing for selectively covering and exposing said apertures.

5. The fire-hose nozzle according to claim 4 wherein said housing includes a biased latch having a pin that rides within a slot on said collar to prevent inadvertent removal thereof.

6. The fire-hose nozzle according to claim 4 wherein said collar includes a raised, semi-circumferential lip that provides an engagement surface for a firefighter's hand when sliding said collar forward and backward.

7. The fire-hose nozzle according to claim 2 further comprising a hollow, elongated sleeve having a first end and an opposing second end with a water conduit formed therebetween, said first end telescopically receiving the outlet of said housing, said sleeve slidable between a retracted position and an extended position, whereby when in the extended position, said sleeve projects water in a streamlined, concentrated flow pattern and when in the retracted position, said sleeve projects water in a wide spray pattern.

8. The fire-hose nozzle according to claim 7 wherein the first end of said sleeve includes a circumferential band with a guide pin depending from an interior surface, said guide pin riding within a longitudinal slot on said housing, said slot having a transverse notch at a distal end into which said guide pin is rotated to lock said sleeve in the retracted position.

9. The fire-hose nozzle according to claim 2 further comprising a quick-connect fitting on the inlet of said housing for coupling with a foaming-agent source to facilitate oxygen depravation of an ongoing fire.

10. A fire-hose nozzle comprising:

a housing having an inlet, an outlet and an interior water passageway therebetween;

an elongated, rocket-shaped stem centrally suspended within said water passageway, said rocket-shaped stem fixedly attached to said housing;

a controller coupled with said inlet and a fire hose distal end for controlling water flow from a fire hose to said water passageway, whereby when water is delivered to said passageway, the stem disrupts and separates incoming water to decrease back pressure, recoil and oscillation of said fire hose;

a plurality of apertures circumferentially disposed around the inlet of said housing for injecting ambient air into incoming water to widen a spray pattern through said outlet, and to atomize incoming water to more effectively extinguish a fire;

a collar slidably mounted on said housing for selectively covering and exposing said apertures;

a biased latch on said housing, said biased latch having a pin that rides within a slot on said collar to prevent inadvertent removal thereof.

11. The fire-hose nozzle according to claim 10 wherein said stem has a large-diameter tubular portion near the inlet and a tapered, pointed portion near the outlet.

12. The fire-hose nozzle according to claim 10 wherein said rocket-shaped stem is fixedly attached to said housing with bolts radially extending from said stem to said housing that axially suspend said stem within said water passageway.

13. The fire-hose nozzle according to claim 10 wherein said collar includes a raised, semi-circumferential lip that provides an engagement surface for a firefighter's hand when sliding said collar forward and backward.

14. The fire-hose nozzle according to claim 10 further comprising a hollow, elongated sleeve having a first end and an opposing second end with a water conduit formed therebetween, said first end telescopically receiving the outlet of said housing, said sleeve slidable between a retracted position and an extended position, whereby when in the extended position, said sleeve projects water in a streamlined, concentrated flow pattern and when in the retracted position, said sleeve projects water in a wide spray pattern.

15. The fire-hose nozzle according to claim 14 wherein the first end of said sleeve includes a circumferential band with a guide pin depending from an interior surface, said guide pin riding within a longitudinal slot on said housing, said slot having a transverse notch at a distal end into which said guide pin is rotated to lock said sleeve in the retracted position.

16. The fire-hose nozzle according to claim 10 further comprising a quick-connect fitting on the inlet of said housing for coupling with a foaming-agent source to facilitate oxygen depravation of an ongoing fire.

* * * * *